US009995019B2

(12) United States Patent
Kosarev

(10) Patent No.: US 9,995,019 B2
(45) Date of Patent: Jun. 12, 2018

(54) ESTIMATION WITH GYROS OF THE RELATIVE ATTITUDE BETWEEN A VEHICLE BODY AND AN IMPLEMENT OPERABLY COUPLED TO THE VEHICLE BODY

(71) Applicant: LLC "Topcon Positioning Systems", Moscow (RU)

(72) Inventor: Alexey Andreevich Kosarev, Moscow (RU)

(73) Assignee: Topcon Positioning Systems, Inc., Livermore, CA (US)

( * ) Notice: Subject to any disclaimer, the term of this patent is extended or adjusted under 35 U.S.C. 154(b) by 0 days. days.

(21) Appl. No.: 15/311,081

(22) PCT Filed: Jun. 23, 2014

(86) PCT No.: PCT/RU2014/000445
§ 371 (c)(1),
(2) Date: Nov. 14, 2016

(87) PCT Pub. No.: WO2015/199570
PCT Pub. Date: Dec. 30, 2015

(65) Prior Publication Data

US 2017/0114528 A1 Apr. 27, 2017

(51) Int. Cl.
*G06F 19/00* (2018.01)
*G05D 1/02* (2006.01)
(Continued)

(52) U.S. Cl.
CPC ..... *E02F 9/265* (2013.01); *E02F 3/845* (2013.01); *E02F 3/7618* (2013.01)

(58) Field of Classification Search
CPC ..... E02F 9/265; E02F 3/845
(Continued)

(56) References Cited

U.S. PATENT DOCUMENTS 4,157,118 A * 6/1979 Suganami ..... E02F 3/845 172/12
5,860,480 A * 1/1999 Jayaraman ..... E02F 3/845 172/2
(Continued)

FOREIGN PATENT DOCUMENTS

EP 1257784 B1 6/2006
SU 940651 A3 6/1982
(Continued)

OTHER PUBLICATIONS

International Search Report and Written Opinion dated Mar. 26, 2015, in connection with International Patent Application No. PCT/RU14/00445, 6 pages.
(Continued)

*Primary Examiner* — Muhammad Shafi
(74) *Attorney, Agent, or Firm* — Chiesa Shahinian & Giantomasi PC

(57) ABSTRACT

An estimate of the relative attitude between an implement and a vehicle body is computed from a body angular velocity measurement received from at least one body gyro mounted on the vehicle body and from an implement angular velocity measurement received from at least one implement gyro mounted on the implement. A first system state vector estimate corresponding to a first time instant includes a representation of a first relative attitude estimate. An updated system state vector is computed based at least in part on the first system state vector estimate, the body angular velocity vector measurement, and the implement angular velocity vector measurement. A second system state vector estimate corresponding to a second time instant is predicted based at least in part on the updated system state vector and a time-dependent system model. The second
(Continued)

system state vector estimate includes a representation of a second relative attitude estimate.

21 Claims, 11 Drawing Sheets

(51) Int. Cl.
*E02F 9/26* (2006.01)
*E02F 3/84* (2006.01)
*E02F 3/76* (2006.01)

(58) Field of Classification Search
USPC ..... 701/300, 50
See application file for complete search history.

(56) References Cited

U.S. PATENT DOCUMENTS 9,052,391 B2 * 6/2015 Friend ..... G06F 11/30
9,145,144 B2 * 9/2015 Friend ..... B60W 40/076
9,347,205 B2 * 5/2016 Kosarev ..... E02F 3/845
9,618,338 B2 * 4/2017 Fehr ..... G01C 9/08
9,624,650 B2 * 4/2017 Stratton ..... E02F 9/265
2012/0239258 A1 9/2012 Konno et al.
2013/0261902 A1 * 10/2013 Zhdanov ..... E02F 3/7613 701/50

FOREIGN PATENT DOCUMENTS

WO 2001057474 A1 8/2001
WO 2008120145 A1 10/2008
WO 2013119140 A1 8/2013
WO WO-2013-119140 * 8/2013
WO 2013148148 A1 10/2013

OTHER PUBLICATIONS

Extended European Search Report dated Jan. 26, 2018, in connection with EP Patent application No. 14895694.9; 9 pgs.

* cited by examiner (E31)

$$A_k = \begin{bmatrix} 1 & -\delta_{x2,k} & -\delta_{y2,k} & -\delta_{z2,k} & -q_{1,k} & -q_{2,k} & -q_{3,k} & 0 & 0 & 0 \\ \delta_{x2,k} & 1 & \delta_{z2,k} & -\delta_{y2,k} & q_{0,k} & -q_{3,k} & q_{2,k} & 0 & 0 & 0 \\ \delta_{y2,k} & -\delta_{z2,k} & 1 & \delta_{x2,k} & q_{3,k} & q_{0,k} & -q_{1,k} & 0 & 0 & 0 \\ \delta_{z2,k} & \delta_{y2,k} & -\delta_{x2,k} & 1 & -q_{2,k} & q_{1,k} & q_{0,k} & 0 & 0 & 0 \\ 0 & 0 & 0 & 0 & 1 & 0 & 0 & 0 & 0 & 0 \\ 0 & 0 & 0 & 0 & 0 & 1 & 0 & 0 & 0 & 0 \\ 0 & 0 & 0 & 0 & 0 & 0 & 1 & 0 & 0 & 0 \\ 0 & 0 & 0 & 0 & 0 & 0 & 0 & 1 & 0 & 0 \\ 0 & 0 & 0 & 0 & 0 & 0 & 0 & 0 & 1 & 0 \\ 0 & 0 & 0 & 0 & 0 & 0 & 0 & 0 & 0 & 1 \end{bmatrix}$$

FIG. 4

ESTIMATION WITH GYROS OF THE RELATIVE ATTITUDE BETWEEN A VEHICLE BODY AND AN IMPLEMENT OPERABLY COUPLED TO THE VEHICLE BODY

CROSS-REFERENCE TO RELATED APPLICATIONS

This application is a national stage (under 35 U.S.C. 371) of International Patent Application No. PCT/RU2014/000445, filed Jun. 23, 2014, which is herein incorporated by reference in its entirety.

BACKGROUND OF THE INVENTION

The present invention relates generally to control of an implement operably coupled to a body of a vehicle, and more particularly to the estimation, using gyros, of the attitude of the implement relative to the body of the vehicle.

In particular earthmoving operations, the attitude and position of an implement operably coupled to a vehicle body needs to be accurately controlled; consequently, the attitude and position of the implement needs to be accurately measured. In grading applications with a dozer, for example, the attitude and position of the dozer blade needs to be accurately controlled, and accurate measurements of the attitude and position of the dozer blade are needed. In some machine control systems, the attitude and position of the dozer blade are measured by sensors mounted on the dozer blade. The position of the dozer blade can be measured, for example, with a Global Navigation Satellite System (GNSS) receiver or a laser system. In these systems, a mast is installed on the dozer blade to support a GNSS antenna, a laser prism, or a laser receiver. The attitude of the dozer blade can be measured with two GNSS antennas, two laser prisms, or two laser receivers. Each GNSS antenna, laser prism, or laser receiver is supported by an individual mast installed on the dozer blade.

During earthmoving operations, the sensors are exposed to harsh environmental conditions, including high levels of shock and vibration, wide ranges of high and low temperatures, exposure to water, and impact with soil, stones, and rocks. Sensors mounted on a mast, in particular, are exposed and susceptible to damage.

BRIEF SUMMARY OF THE INVENTION

An implement is operably coupled to a vehicle body. In an embodiment of the invention, the relative attitude between the implement and the vehicle body is estimated. A first system state vector estimate is received. The first system state vector corresponds to a first time instant and includes a representation of a first relative attitude estimate corresponding to the first time instant. A body angular velocity measurement from at least one body gyro mounted on the vehicle body is received, and an implement angular velocity measurement from at least one implement gyro mounted on the implement is received. An updated system state vector is computed based at least in part on the first system state vector estimate, the body angular velocity vector measurement, and the implement angular velocity vector measurement. A second system state vector estimate is predicted. The second system state vector estimate is based at least in part on the updated system state vector and a time-dependent system model, corresponds to a second time instant, and includes a representation of a second relative attitude estimate corresponding to the second time instant.

These and other advantages of the invention will be apparent to those of ordinary skill in the art by reference to the following detailed description and the accompanying drawings.

BRIEF DESCRIPTION OF THE DRAWINGS

FIG. 4 shows a Jacobian matrix;

DETAILED DESCRIPTION

In general, embodiments of the invention described below can be used for a vehicle including a vehicle body and an implement operably coupled to the vehicle body. An implement operably coupled to a vehicle body refers to an implement whose attitude relative to the vehicle body can be varied and controlled, either manually by an operator or automatically by a control system. In some vehicles, both the attitude and the position of the implement relative to the vehicle body can be varied and controlled.

Embodiments of the invention can be used, for example, for construction vehicles such as earthmoving machines (including dozers and motorgraders) and pavers: a dozer includes a dozer body and a dozer blade operably coupled to the dozer body; a motorgrader includes a motorgrader body (frame) and a motorgrader blade operably coupled to the motorgrader body; and a paver includes a paver body and a screed operably coupled to the paver body. In the discussions below, a dozer is used as a representative example of a vehicle for which embodiments of the invention can be used.

Figure 1:
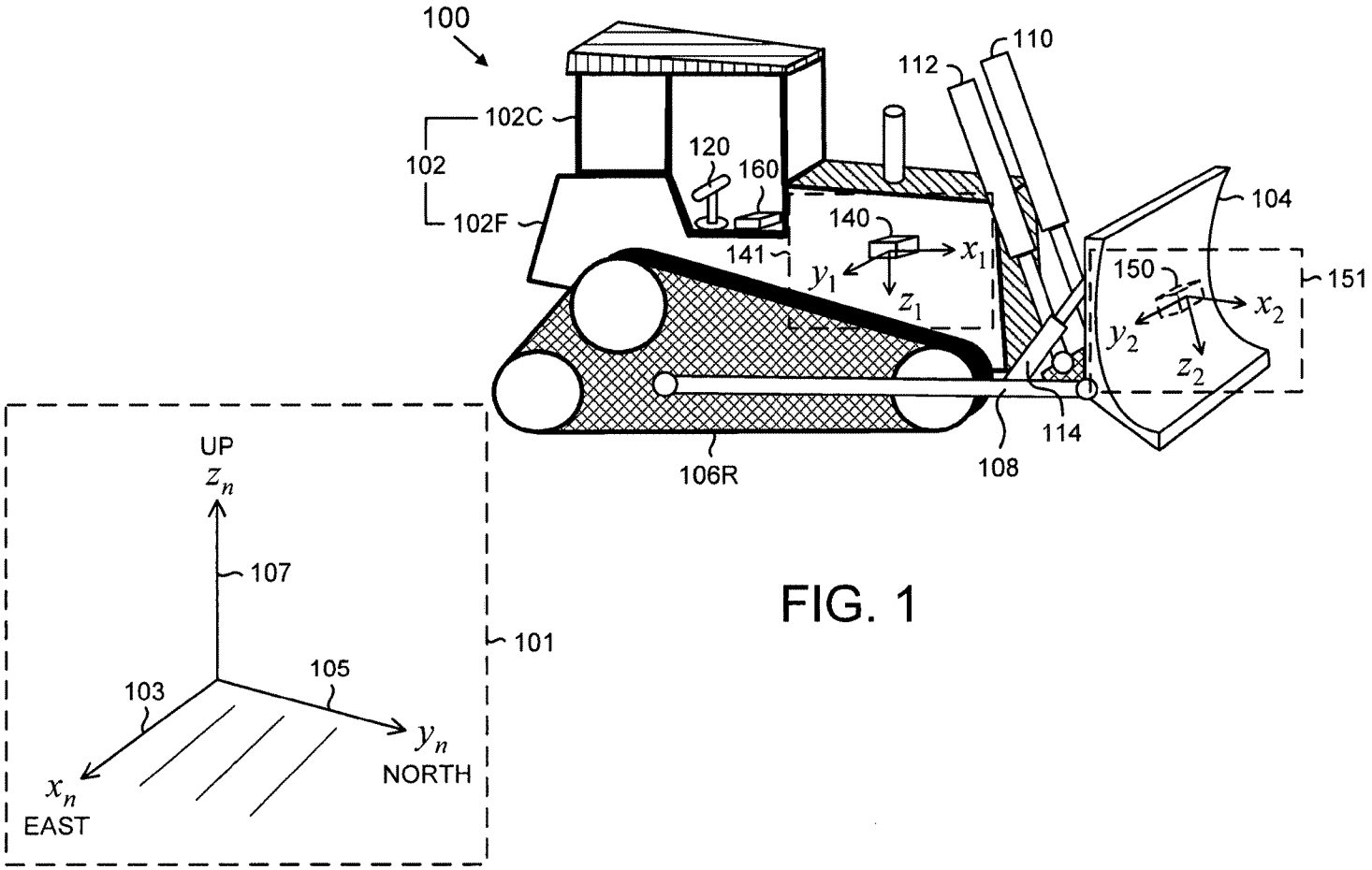
FIG. 1 shows a schematic representation of a dozer and Cartesian reference frames.

FIG. 1 shows a schematic of a dozer 100, which includes a dozer body 102 and a dozer blade 104. The dozer body 102 includes a mainframe 102F and a cabin 102C, in which the operator sits. The dozer 100 travels across ground via a right track 106R and a left track (not shown); left and right are viewed from the perspective of the operator sitting in the cabin 102C. The dozer blade 104 is operably coupled to the dozer body 102 via support arms and hydraulic cylinders. The number of support arms and hydraulic cylinders varies with different dozer designs. FIG. 1 shows support arm 108 as a representative support arm and shows hydraulic cylinder 110, hydraulic cylinder 112, and hydraulic cylinder 114 as representative hydraulic cylinders.

In general, both the attitude (angular orientation) and the position of the dozer blade 104 relative to the dozer body 102 can be controlled by controlling the extensions of the hydraulic cylinders. The hydraulic cylinders can be controlled manually by an operator (for example, via the joystick 120) or automatically by a computer control system.

For grading operations, parameters such as the height of the dozer blade above the ground and the slope of the dozer blade relative to the ground are controlled. A system-state estimate system computes an estimate of the current system state and generates a feedback signal corresponding to the estimate of the current system state. In a manual control system, the feedback signal is inputted into a display system that displays the current values of the dozer blade parameters (such as the height and the slope of the dozer blade) on a lightbar or video display, and an operator manually adjusts the dozer blade to achieve and maintain the desired (target) values of the dozer blade parameters. In an automatic control system, the feedback signal is transformed into a control signal that is used by a hydraulic control system to automatically control the height and the slope of the dozer blade.

The geometrical configurations of dozers and the degrees of freedom of the dozer blade relative to the dozer body vary among different models of dozers. In the most general case, a dozer blade can have up to six degrees of freedom (three angular rotations varying the relative attitude between the dozer blade and the dozer body and three translations varying the relative position between the dozer blade and the dozer body). In most cases, a dozer is equipped with a 4-way blade or a 6-way blade. A 4-way blade has two degrees of freedom: lift and tilt. The lift is adjustable in two ways (up and down), and the tilt is adjustable in two ways (clockwise and counter-clockwise). A 6-way blade has three degrees of freedom: lift, tilt, and angle. The lift is adjustable in two ways (up and down), the tilt is adjustable in two ways (clockwise and counter-clockwise), and the angle is adjustable in two ways (left and right).

In practice, the number of parameters of the dozer blade to be controlled depends on the application. If the application requires control of only the slope of the dozer blade relative to the ground, then an estimate of the dozer blade attitude relative to the dozer body is sufficient. If the application requires control of both the slope of the dozer blade and the position of the dozer blade relative to the ground, then both an estimate of the dozer blade attitude relative to the dozer body and an estimate of the dozer blade position relative to the dozer body are needed.

If the dozer blade has no more than three degrees of freedom, an estimate of the dozer blade position relative to the dozer body can be calculated from the estimate of the dozer blade attitude relative to the dozer body. If the dozer blade has more than three degrees of freedom, additional measurements (such as the attitudes of support arms), along with the estimate of the dozer blade attitude relative to the dozer body, are needed to determine an estimate of the dozer blade position relative to the dozer body. Algorithms for calculating an estimate of the dozer blade position relative to the dozer body based on an estimate of the dozer blade attitude relative to the dozer body and based on geometrical parameters of the dozer are well-known in the art and are not described in further detail herein.

Values of the dozer blade attitude and the dozer blade position relative to the dozer body can then be used in combination with values of the dozer body attitude and the dozer body position relative to a local or geodetic coordinate system to calculate the values of the dozer blade attitude and the dozer blade position relative to the local or geodetic coordinate system. Refer to FIG. 1. An example of a local or geodetic coordinate system is the local navigation reference frame 101. The Cartesian axes of the local navigation reference frame 101 are denoted ENU [East ($x_n$) 103, North ($y_n$) 105, Up ($z_n$)) 107]. In common practice, the $x_n$-$y_n$ plane is tangent to the World Geodetic System 1984 (WGS-84) Earth ellipsoid; however, various other orientations can be used.

Values of the dozer body attitude and the dozer body position relative to a local or geodetic coordinate system can be calculated from sensors such as global navigation satellite system (GNSS) antennas, laser prisms, and laser receivers mounted on the dozer body (for example, mounted on the roof of the cabin). Algorithms for calculating the values of the dozer blade attitude and the dozer blade position relative to the local or geodetic coordinate system, based on values of the dozer blade attitude and the dozer blade position relative to the dozer body in combination with values of the dozer body attitude and the dozer body position relative to a local or geodetic coordinate system, are well known to those skilled in the art and are not discussed in further detail herein.

Values of the dozer blade attitude and the dozer blade position relative to the local or geodetic coordinate system can then be used to generate a feedback signal in a manual blade control system or an automatic blade control system. Algorithms for generating a feedback signal from values of the dozer blade attitude and the dozer blade position relative to the local or geodetic coordinate system are well known to those skilled in the art and are not discussed in further detail herein. As discussed above, depending on the application, different parameters of the dozer blade can be controlled; the feedback signal depends on the parameters to be controlled.

PCT International Publication No. WO 2013/119140 ("Estimation of the Relative Attitude and Position between a Vehicle Body and an Implement Operably Coupled to the Vehicle Body") describes a method for estimating the relative dozer blade attitude between the dozer blade and the dozer body using accelerometers or a combination of accelerometers and gyros.

In an embodiment of the invention described herein, an estimate of the current system state is computed based on measurements from gyros mounted on the dozer body and on the dozer blade. In an advantageous embodiment, the gyros are mounted in an inertial measurement unit (IMU) with a robust housing to withstand harsh environmental conditions. In FIG. 1, the inertial measurement unit IMU1 140 is mounted on the dozer body 102, and the inertial measurement unit IMU2 150 is mounted on the rear of the dozer blade 104. The IMU1 140 can be mounted in the cabin 102C or on the mainframe 102F. If the cabin 102C has a suspension, then the IMU1 140 should be mounted on the mainframe 102F to avoid spurious influences of cabin vibration to the IMU1 140. In the embodiment shown, IMU1 140 and IMU2 150 each include three orthogonally-mounted gyros. In other embodiments, an IMU includes one gyro or two orthogonally-mounted gyros (depending on the number of angular degrees of freedom to be measured). The configurations of the IMUs can be the same or can be different.

Shown in FIG. 1 are two Cartesian measurement reference frames: the body frame 141 and the blade frame 151. The origin of the body frame 141 is placed at the origin of the IMU1 140, and the measurement axes of the IMU1 140 are aligned with the axes of the body frame 141. Similarly, the origin of the blade frame 151 is placed at the origin of the IMU2 150, and the measurement axes of the IMU2 150 are aligned with the axes of the blade frame 151.

Figure 2A:
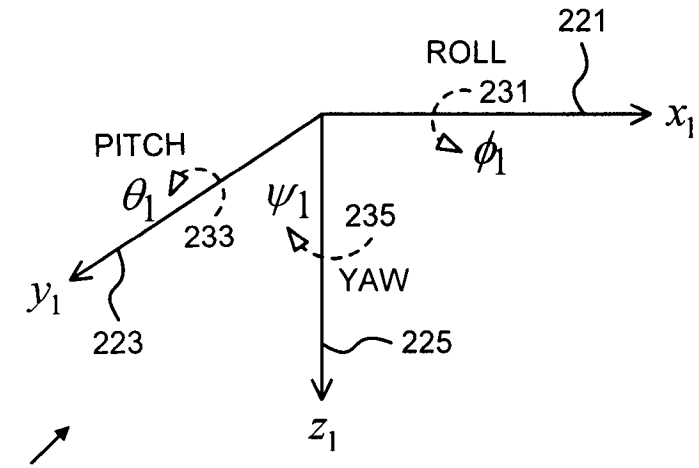
FIG. 2A and FIG. 2B show details of Cartesian reference frames.

The body frame 141 is fixed with respect to the dozer body 102 and is defined by three orthogonal axes (FIG. 2A):

$x_1$-axis 221, $y_1$-axis 223, and $z_1$-axis 225. The $x_1$-axis is directed along the roll axis of the dozer body 102; the $y_1$-axis is directed along the pitch axis of the dozer body 102; and the $z_1$-axis is directed along the yaw axis of the dozer body 102. Each angle is measured counter-clockwise about the respective positive axis (right-hand rule): the rotation about the body $x_1$-axis is the body roll angle $\phi_1$ 231; the rotation about the body $y_1$-axis is the body pitch angle $\theta_1$ 233; and the rotation about the body $z_1$-axis is the body yaw angle $\psi_1$ 235. Gyros in the IMU1 140 measure components of the body angular velocity projected onto the $x_1$, $y_1$, and $z_1$ axes.

Figure 2B:
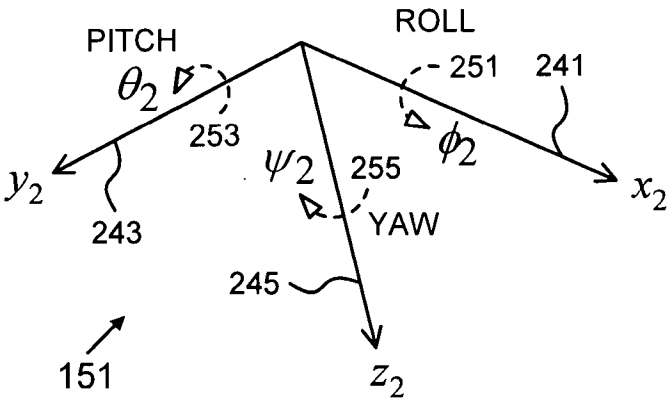

The blade frame 151 is fixed with respect to the dozer blade 104 and is defined by three orthogonal axes (FIG. 2B): $x_2$-axis 241, $y_2$-axis 243, and $z_2$-axis 245. The $x_2$-axis is directed along the roll axis of the dozer blade 104; the $y_2$-axis is directed along the pitch axis of the dozer blade 104; and the $z_2$-axis is directed along the yaw axis of the dozer blade 104. Each angle is measured counter-clockwise about the respective positive axis (right-hand rule): the rotation about the blade $x_2$-axis is the blade roll angle $\phi_2$ 251; the rotation about the blade $y_2$-axis is the blade pitch angle $\theta_2$ 253; and the rotation about the blade $z_2$-axis is the blade yaw angle $\psi_2$ 255. Gyros in the IMU2 150 measure components of the blade angular velocity projected onto the $x_2$, $y_2$, and $z_2$ axes.

Figure 3B:
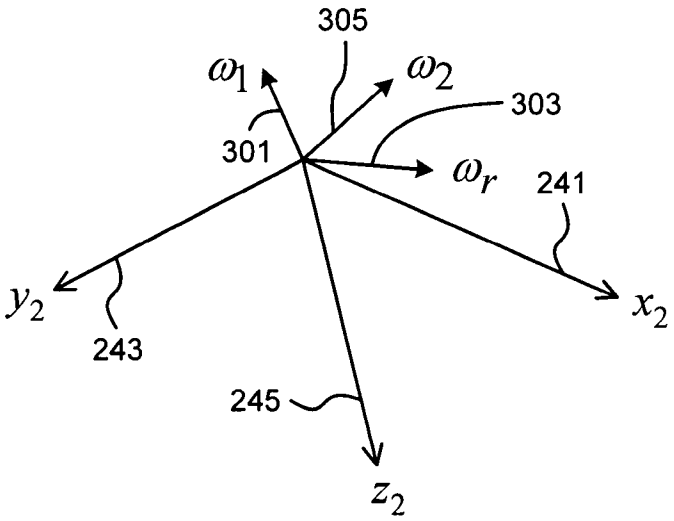
FIG. 3A and FIG. 3B show reference vector diagrams for angular velocities.
Figure 3A:
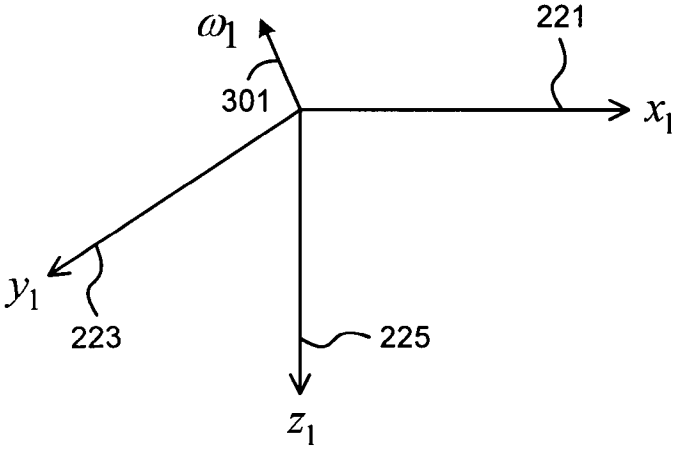

Refer to the vector diagrams shown in FIG. 3A and FIG. 3B. In FIG. 3A, the dozer body 102 is rotating with an angular velocity $\omega_1$ 301. In the body frame, the angular velocity $\omega_1$ is referenced as $\omega_{1_1}$ and represented by $$\omega_{1_1} = \begin{bmatrix} \omega_{1x1} \\ \omega_{1y1} \\ \omega_{1z1} \end{bmatrix}, \tag{E1}$$

where $\omega_{1x1}$, $\omega_{1y1}$, $\omega_{1z1}$ are the components of $\omega_1$ projected onto the $x_1$, $y_1$, $z_1$ axis, respectively. In FIG. 3B, the dozer blade 104 is rotating with respect to the dozer body 102 with a relative angular velocity $\omega_r$ 303. If the dozer body 102 is rotating with an angular velocity $\omega_1$ 301, then the dozer blade is rotating with an angular velocity $\omega_2$, where $$\omega_2=\omega_1+\omega_r. \tag{E2}$$

In the blade frame, the angular velocity $\omega_2$ is referenced as $\omega_{2_2}$ and represented by $$\omega_{2_2} = \begin{bmatrix} \omega_{2x2} \\ \omega_{2y2} \\ \omega_{2z2} \end{bmatrix}, \tag{E3}$$

where $\omega_{2x2}$, $\omega_{2y2}$, $\omega_{2z2}$ are the components of $\omega_2$ projected onto the $x_2$, $y_2$, $z_2$ axes, respectively. The IMU1 140 measures the values ($\omega_{1x1}$, $\omega_{1y1}$, $\omega_{1z1}$), and the IMU2 150 measures the values ($\omega_{2x2}$, $\omega_{2y2}$, $\omega_{2z2}$).

The dozer blade attitude relative to the dozer body can be represented in one of three following forms:

three Euler angles: roll, pitch, and yaw;

direction cosine matrix (DCM): nine direction cosines; and rotation quaternion:

$$q=[q_0,q_1,q_2,q_3],(q_0^2+q_1^2+q_2^2+q_3^2=1). \tag{E4}$$

The embodiment described below uses a rotation quaternion as the representation of the dozer blade attitude relative to the dozer body. One skilled in the art can develop embodiments in which Euler angles or DCM are used as the attitude representation.

Using the rotation quaternion q as the attitude representation, the dozer blade angular velocity vector, projected onto the axes of the body frame, is written as:

$$\omega_{2_1}=q\omega_{2_2}q^{-1}. \tag{E5}$$

The dozer blade angular velocity vector relative to the dozer body, projected onto the axes of the body frame, is written as:

$$\omega_{r_1}=q\omega_{2_2}q^{-1}-\omega_{1_1}. \tag{E6}$$

A system can be described by a discrete time state space model:

$$\mathcal{X}_{k+1}=f(\mathcal{X}_k), \tag{E7}$$

where:

time is represented by discrete time epochs $t_k=t_0+k\Delta t$, where $t_0$ is an initial time, k is an integer, and $\Delta t$ is the time interval between epochs (also referred to as the epoch duration);

$\mathcal{X}_k$ represents the system state vector at time epoch $t_k$;

$\mathcal{X}_{k+1}$ represents the system state vector at time epoch $t_{k+1}$; and $f$ represents a generalized system state function.

As discussed below, the extended Kalman filter procedure is used for calculating the estimate of the rotation quaternion. A brief summary of the extended Kalman filter procedure is first presented.

In the extended Kalman filter procedure, the following system equations are used for discrete time:

$$\mathcal{X}_{k+1}=f(\mathcal{X}_k)+w_k \tag{E8}$$

$$\mathcal{X}_k=h(\mathcal{X}_k)+v_k, \tag{E9}$$

where:

$\mathcal{X}_k$ represents the system state vector at time epoch $t_k$;

$\mathcal{X}_{k+1}$ represents the system state vector at time epoch $t_{k+1}$;

$f$ represents a generalized system state function $w_k$ represents the process noise vector at time epoch $t_k$;

$\mathcal{X}_k$ represents the measurement vector at time epoch $t_k$;

$v_k$ represents the measurement noise vector at time epoch $t_k$; and h represents a generalized measurement function.

The process noise vector $w_k$ has a covariance matrix $Q_k$; and the measurement noise vector $v_k$ has a covariance matrix $R_k$.

To estimate the system state vector $\mathcal{X}$ from the measurement vector $\mathcal{X}$, the following extended Kalman filter procedure is used. At time epoch $t_k$, the Jacobian matrices $A_k$ and $H_k$ are calculated. The [i, j]-th element of the matrix $A_k$ (where i and j are integer indices) is given by $$A_{k[i,j]} = \frac{\partial f(x_k)_{[i]}}{\partial x_{k[j]}}. \tag{E10}$$

The [i, j]-th element of the matrix $H_k$ is given by $$H_{k[i,j]} = \frac{\partial h(x_k)_{[i]}}{\partial x_{k[j]}}. \tag{E11}$$

The system state vector estimate is updated by a new measurement vector $\mathcal{X}_k$ as follows:

$$K_k=P_kH_k^T(H_kP_kH_k^T+R_k)^{-1} \quad \text{(E12)}$$

$$\mathcal{X}_k=h(\mathcal{X}_k) \quad \text{(E13)}$$

$$\mathcal{X}_k=\mathcal{X}_k+K_k(\mathcal{X}_k-\mathcal{X}_k) \quad \text{(E14)}$$

where:

$P_k$ is the system state vector estimate covariance matrix at time epoch $t_k$; and $K_k$ is the Kalman gain at time epoch $t_k$.

The symbol $\mathcal{X}_k$ denotes an estimate of $\mathcal{X}_k$.

The new system state vector estimate is then predicted using the system equations:

$$\mathcal{X}_{k+1}=f(\mathcal{X}_j) \quad \text{(E15)}$$

$$P_{k+1}=A_kP_kA_k^T+Q_k. \quad \text{(E15)}$$

The following extended Kalman filter procedure is used for calculating the estimate of the rotation quaternion $\hat{q}$. A state vector of the dozer system includes the rotation quaternion, the dozer body angular velocity, and the dozer blade angular velocity relative to the dozer body. The system state vector can include other components as well. In an embodiment, the system state vector $\mathcal{X}_k$ comprises the following components:

$$x_k=\begin{bmatrix} q_{0,k} \\ q_{1,k} \\ q_{2,k} \\ q_{3,k} \\ \delta_{x2,k} \\ \delta_{y2,k} \\ \delta_{z2,k} \\ \omega_{1x2,k} \\ \omega_{1y2,k} \\ \omega_{1z2,k} \end{bmatrix}, \quad \text{(E17)}$$

where:

$\mathcal{X}_k$ is the system state vector at time epoch $t_k$;

$q_{0,k}$, $q_{1,k}$, $q_{2,k}$, $q_{3,k}$ are the components of the rotation quaternion $q_k$ at time epoch $t_k$; and the values $\delta_{(\bullet),k}$ are defined by the following equations:

$$\delta_{x2,k}=\tfrac{1}{2}\omega_{rx2,k}\Delta t \quad \text{(E18)}$$

$$\delta_{y2,k}=\tfrac{1}{2}\omega_{ry2,k}\Delta t \quad \text{(E19)}$$

$$\delta_{z2,k}=\tfrac{1}{2}\omega_{rz2,k}\Delta t \quad \text{(E20)}$$

where:

$\Delta t$ is the time interval between epochs (epoch duration); and $\omega_{rx2,k}$, $\omega_{ry2,k}$, $\omega_{rz2,k}$ are the components of $\omega_r$ (the relative angular velocity of the blade with respect to the body) projected onto the $x_2$, $y_2$, $z_2$ axis, respectively, of the blade frame at time epoch $t_k$; and $\omega_{1x2,k}$, $\omega_{1y2,k}$, $\omega_{1z2,k}$ are the components of the body angular velocity $\omega_1$ projected onto the $x_2$, $y_2$, $z_2$ axis, respectively, of the blade frame at time epoch $t_k$.

Once the system state vector has been determined, the quaternion can be extracted from components of the system state vector.

For the extended Kalman filter procedure, the initial estimate of the system state vector is required at the start up of the system. The system state vector can be initialized by the identity rotation quaternion, $\hat{q}=[1,0,0,0]$. The identity rotation quaternion corresponds to the axes of the blade frame 151 pointing along the same directions as the axes of the body frame 141.

The discrete time state space equation for this system is given by (E8) above. With $\mathcal{X}_k$ given by (E17), the components of (E8) are the following:

$$q_{0,k+1}=q_{0,k}-q_{1,k}\delta_{x2,k}-q_{2,k}\delta_{y2,k}-q_{3,k}\delta_{z2,k}+w_{q0,k} \quad \text{(E21)}$$

$$q_{1,k+1}=q_{1,k}-q_{0,k}\delta_{x2,k}-q_{3,k}\delta_{y2,k}-q_{2,k}\delta_{z2,k}+w_{q1,k} \quad \text{(E22)}$$

$$q_{2,k+1}=q_{2,k}-q_{3,k}\delta_{x2,k}-q_{0,k}\delta_{y2,k}-q_{1,k}\delta_{z2,k}+w_{q2,k} \quad \text{(E23)}$$

$$q_{3,k+1}=q_{3,k}-q_{2,k}\delta_{x2,k}-q_{1,k}\delta_{y2,k}-q_{0,k}\delta_{z2,k}+w_{q3,k} \quad \text{(E24)}$$

$$\delta_{x2,k+1}=\delta_{x2,k}+w_{\delta x2,k} \quad \text{(E25)}$$

$$\delta_{y2,k+1}=\delta_{y2,k}+w_{\delta y2,k} \quad \text{(E26)}$$

$$\delta_{z2,k+1}=\delta_{z2,k}+w_{\delta z2,k} \quad \text{(E27)}$$

$$\omega_{1x2,k+1}=\omega_{1x2,k}+w_{\omega 1x2,k} \quad \text{(E28)}$$

$$\omega_{1y2,k+1}=\omega_{1y2,k}+w_{\omega 1y2,k} \quad \text{(E29)}$$

$$\omega_{1z2,k+1}=\omega_{1z2,k}+w_{\omega 1z2,k} \quad \text{(E30)}$$

where $w_{(\bullet),k}$ represents the component of $w_k$ corresponding to the component $\mathcal{X}_{(\bullet),k}$ of $\mathcal{X}_k$.

The elements of the Jacobian matrix $A_k$ is calculated from (E10) as $$A_{k[i,j]}=\frac{\partial f(x_k)_{[i]}}{\partial x_{k[j]}}.$$

The result $A_k$ is shown in FIG. 4 as (E31).

In an embodiment, the body angular velocity and the blade angular velocity are measured. The system measurement equations for the body angular velocity and the blade angular velocity are described below.

The system measurement equation for the body angular velocity is given by $$\omega_{1,k}=h_1(\mathcal{X}_k)+v_k, \quad \text{(E32)}$$

where:

$\omega_{1,k}$ is the body angular velocity $\omega_1$ at time epoch $t_k$;

$v_k$ is the measurement noise vector at time epoch $t_k$; and $h_1$ is a generalized measurement function.

The components of (E32) are the following:

$$\omega_{1x1,k}=(q_{0,k}^2+q_{1,k}^2-q_{2,k}^2-q_{3,k}^2)\omega_{1x2,k}+2(q_{1,k}q_{2,k}-q_{0,k}q_{3,k})\omega_{1y2,k}+2(q_{1,k}q_{3,k}+q_{0,k}q_{2,k})\omega_{1z2,k}+v_{1x1,k} \quad \text{(E33)}$$

$$\omega_{1y1,k}=2(q_{1,k}q_{2,k}+q_{0,k}q_{3,k})\omega_{1x2,k}+(q_{0,k}^2-q_{1,k}^2+q_{2,k}^2-q_{3,k}^2)\omega_{1y2,k}+2(q_{2,k}q_{3,k}-q_{0,k}q_{1,k})\omega_{1z2,k}+v_{1y1,k} \quad \text{(E34)}$$

$$\omega_{1z1,k}=2(q_{1,k}q_{3,k}-q_{0,k}q_{2,k})\omega_{1x2,k}+2(q_{2,k}q_{3,k}+q_{0,k}q_{1,k})\omega_{1y2,k}+(q_{0,k}^2-q_{1,k}^2-q_{2,k}^2+q_{3,k}^2)\omega_{1z2,k}+v_{1z1,k} \quad \text{(E35)}$$

where:

$\omega_{1x1,k}$, $\omega_{1y1,k}$, $\omega_{1z1,k}$ are the components of the body angular velocity $\omega_{1,k}$ projected onto the $x_1$, $z_1$, $z_1$ axes, respectively, of the body frame at time epoch $t_k$; and $v_{1(\bullet),k}$ is the component of $v_k$ corresponding to the component $\omega_{1(\bullet),k}$ of $\omega_{1,k}$.

The system measurement equation for the blade angular velocity is given by:

$$\omega_{2,k}=h_2(\mathcal{X}_k)+v_k \quad \text{(E36)}$$

where:

$\omega_{2,k}$ is the blade angular velocity $\omega_2$ at time epoch $t_k$;

$v_k$ is the measurement noise vector at time epoch $t_k$; and $h_2$ is a generalized measurement function.

The components of (E36) are the following:

$$\omega_{2x2,k} = \omega_{1x2,k} + \frac{2}{\Delta t}\delta_{x2,k} + v_{\omega 2x2,k} \tag{E37}$$

$$\omega_{2y2,k} = \omega_{1y2,k} + \frac{2}{\Delta t}\delta_{y2,k} + v_{\omega 2y2,k} \tag{E38}$$

$$\omega_{2z2,k} = \omega_{1z2,k} + \frac{2}{\Delta t}\delta_{z2,k} + v_{\omega 2z2,k}, \tag{E39}$$

where:

$\omega_{2x2,k}$, $\omega_{2y2,k}$, $\omega_{2z2,k}$ are the components of the blade angular velocity $\omega_{2,k}$ projected onto the $x_2$, $y_2$, $z_2$ axis, respectively, of the blade frame at time epoch $t_k$; and $v_{\omega 2(\bullet),k}$ is the component of $v_k$ corresponding to the component $\omega_{2(\bullet),k}$ of $\omega_{2,k}$.

To improve the accuracy of the system state vector estimate, additional information can be used to update the system state vector. In the quaternion representation, the quaternion norm is a known value, defined to be 1. The actual value of the quaternion norm, computed from the system state vector, will, in general, vary from 1 due to errors and noise. At each time epoch, the value of the quaternion norm can be considered to be a virtual measurement. The system measurement equation for the quaternion norm is then given by:

$$|q_k|=1=h_3(\mathcal{X}_k)+v_k, \tag{E40}$$

where:

$|q_k|$ is the quaternion norm at time epoch $t_k$;

$v_k$ is the measurement noise vector at time epoch $t_k$; and $h_3$ is a generalized measurement function.

In component form, (E40) is written as:

$$|q_k|=1=q_{0,k}^2+q_{1,k}^2+q_{2,k}^2+q_{3,k}^2+v_{|q|,k}, \tag{E41}$$

where $v_{|q|,k}$ represents the noise of the measurement of the rotation quaternion norm at time epoch $t_k$.

As discussed above, the dozer blade attitude relative to the dozer body with, in general, three angular degrees of freedom can be represented by Euler angles (three parameters), a direction cosine matrix (nine parameters), or a quaternion (four parameters). For the Euler-angles representation, the number of parameters is equal to the number of degrees of freedom, and no normalization condition is required. For the direction-cosine-matrix representation and the quaternion representation, the number of parameters exceeds the number of degrees of freedom, and a normalization condition is required. As discussed above, for the quaternion representation, the normalization condition is $q_0^2+q_1^2+q_2^2+q_3^2=1$. For the direction-cosine-matrix representation, the normalization condition is $C^{-1}=C^T$, where C is the direction cosine matrix. Therefore, for the direction-cosine-matrix representation, the system state vector can also be updated with a virtual measurement based on the normalization condition.

In an embodiment, the system state vector is updated when the relative angular velocity of the dozer blade with respect to the dozer body is determined to be zero. The system measurement equation for the relative angular velocity of the dozer blade with respect to the dozer body is given by:

$$\omega_{r,k}=h_4(\mathcal{X}_k)+v_k, \tag{E42}$$

where:

$\omega_{r,k}$ is the relative angular velocity of the blade with respect to the body at time epoch $t_k$;

$v_k$ is the measurement noise vector at time epoch $t_k$; and $h_4$ is a generalized measurement function.

The components of (E42) are the following:

$$\omega_{rx2,k} = \frac{2}{\Delta t}\delta_{x2,k} + v_{\omega rx2,k} \tag{E43}$$

$$\omega_{ry2,k} = \frac{2}{\Delta t}\delta_{y2,k} + v_{\omega ry2,k} \tag{E44}$$

$$\omega_{rz2,k} = \frac{2}{\Delta t}\delta_{z2,k} + v_{\omega rz2,k}, \tag{E45}$$

where:

$\omega_{rx2,k}$, $\omega_{ry2,k}$, $\omega_{rz,2k}$ are the components of the relative angular velocity $\omega_{r,k}$ projected onto the $x_2$, $y_2$, $z_2$ axis, respectively, of the blade frame at time epoch $t_k$; and $v_{\omega r(\bullet),k}$ is the component of $v_k$ corresponding to the component $\omega_{r(\bullet),k}$ of $\omega_{r,k}$.

In an embodiment, the relative angular velocity of the dozer blade with respect to the dozer body is not directly measured. Measurements of control signals (see below), however, can determine whether the relative angular velocity of the dozer blade with respect to the dozer body is zero or non-zero. In the special case in which the relative angular velocity of the dozer blade with respect to the dozer body is zero, the following system measurement equations apply:

$$\omega_{rx2,k} = \frac{2}{\Delta t}\delta_{x2,k} + v_{\omega rx2,k} = 0 \tag{E46}$$

$$\omega_{ry2,k} = \frac{2}{\Delta t}\delta_{y2,k} + v_{\omega ry2,k} = 0 \tag{E47}$$

$$\omega_{rz2,k} = \frac{2}{\Delta t}\delta_{z2,k} + v_{\omega rz2,k} = 0. \tag{E48}$$

The measurement Jacobian matrices $H_k$, with elements $$H_{k[i,j]} = \frac{\partial h(x_k)_{[i]}}{\partial x_{k[j]}}, \tag{E11}$$

are calculated from the above measurement equations. For example, the measurement Jacobian matrix $H_k$ for the blade angular velocity measurement equation $\omega_{2,k}=h_2(\mathcal{X}_k)+v_k$ can be written as:

$$H_k = \begin{bmatrix} 0 & 0 & 0 & 0 & \frac{2}{\Delta t} & 0 & 0 & 1 & 0 & 0 \\ 0 & 0 & 0 & 0 & 0 & \frac{2}{\Delta t} & 0 & 0 & 1 & 0 \\ 0 & 0 & 0 & 0 & 0 & 0 & \frac{2}{\Delta t} & 0 & 0 & 1 \end{bmatrix}. \tag{E49}$$

Using the above equations, the extended Kalman filter procedure can be used to estimate the system state vector at each time epoch $t_k$. The relative attitude between the dozer blade and the dozer body can be calculated from the rotation quaternion $\hat{q}_k$ component of the system state vector estimate $\mathcal{X}_k$. In some dozers, the blade supports provide a direct dependence between the blade relative attitude and the blade relative position. In these cases, the blade relative position can be calculated from the blade relative attitude and from known dozer geometrical parameters.

Figure 5A:
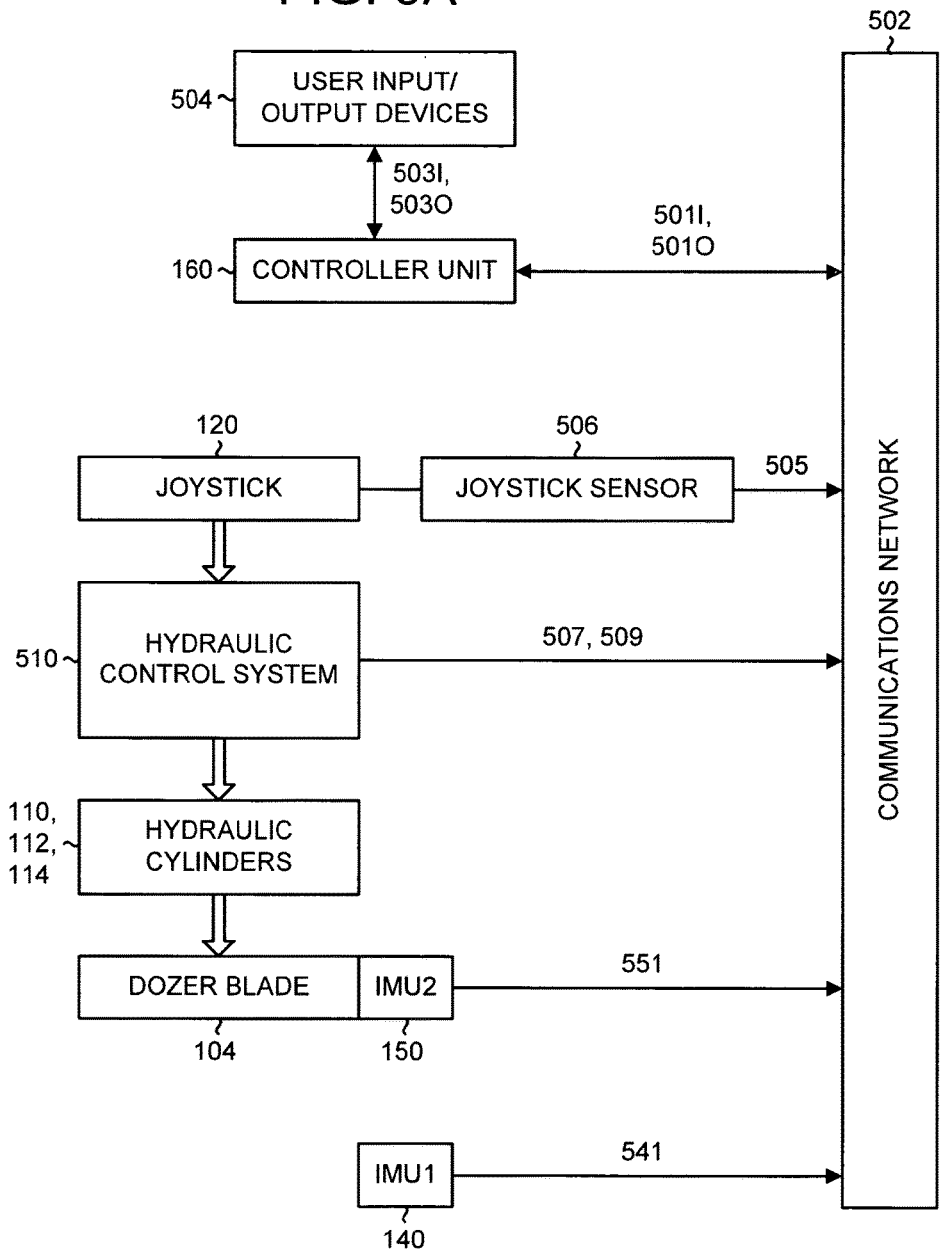
FIG. 5A shows an embodiment of a manual control system.
Figure 5B:
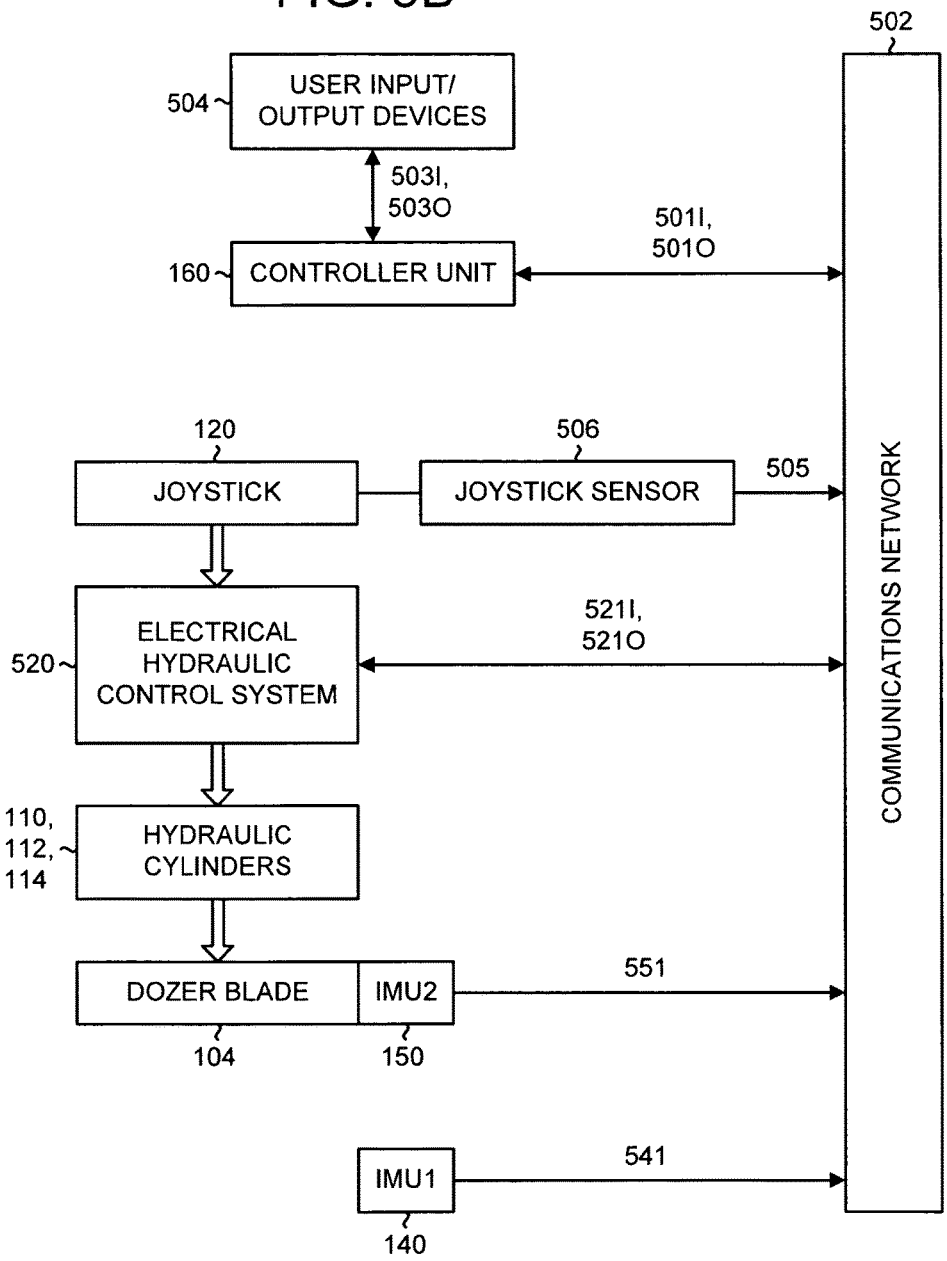
FIG. 5B shows an embodiment of an automatic control system.

Embodiments of systems for estimating the relative attitude between the dozer blade and the dozer body are shown in FIG. 5A and FIG. 5B.

The hydraulic system controlling the extensions of the hydraulic cylinders uses mechanical valves or electric valves. A dozer operator can manually control the hydraulic cylinders via a joystick, such as the joystick 120 in FIG. 1. For controlling mechanical valves, the joystick can be coupled to a Cardan joint, and a mechanical assembly links the Cardan joint to the hydraulic valves. Movement of the joystick controls the hydraulic valves via the Cardan joint and the mechanical assembly. For control of electric valves, the joystick can be coupled to potentiometers. Movement of the joystick controls the settings of the potentiometers, which in turn controls the current or voltage to the solenoids driving the electric valves.

Refer to the embodiment shown in FIG. 5A, which uses a manual hydraulic control system. An operator provides manual input to the hydraulic control system 510 (which can be mechanical or electrical) via the joystick 120. The hydraulic control system 510 controls the flow of hydraulic fluid to the hydraulic cylinders (such as the hydraulic cylinder 110, the hydraulic cylinder 112, and the hydraulic cylinder 114 shown in FIG. 1) and thereby controls the extensions of the hydraulic cylinders. The hydraulic cylinders are operably coupled to the dozer blade 104 and control the relative attitude and the relative position of the dozer blade 104 with respect to the dozer body 102 (FIG. 1).

Various network architectures and protocols can be used for the communications network 502. Examples of the communications network 502 include a controller area network (CAN), an Ethernet network, and an Internet Protocol (IP) network. The IMU1 140, which is mounted on the dozer body 102, sends the signal 541 to the communications network 502. The signal 541 includes measurements of the angular velocity of the dozer body ($\omega_{1x1}$, $\omega_{1y1}$, $\omega_{1z1}$). Similarly, the IMU2 150, which is mounted on the dozer blade 104, sends the signal 551 to the communications network 502. The signal 551 includes measurements of the angular velocity of the dozer blade ($\omega_{2x2}$, $\omega_{2y2}$, $\omega_{2z2}$).

The rotational state of the dozer blade 104 (whether the relative angular velocity of the dozer blade with respect to the dozer body is zero or non-zero) can be determined by the system. For example, the joystick sensor 506 monitors the movement of the joystick 120 and sends the signal 505 to the communications network 502. The signal 505 reports whether the relative angular velocity is zero or non-zero. If the joystick is not moving, then the dozer blade is not rotating relative to the dozer body and is also not translating relative to the dozer body. If the joystick is moving, then the response of the dozer blade is dependent on the control system. In some control systems, movement of the joystick causes only rotation of the dozer blade relative to the dozer body. In other control systems, movement of the joystick can cause rotation or translation (or both) of the dozer blade relative to the dozer body. In these control systems, the response of the dozer blade depends on the trajectory of the joystick (for example, front/back or left/right). The joystick sensor 506 then needs to distinguish movements of the joystick that cause the dozer blade to rotate or rotate and translate from movements of the joystick that cause the dozer blade to translate without rotating.

If the hydraulic control system 510 is a mechanical hydraulic control system, then the joystick sensor 506 can be mechanically coupled to the joystick 120 (for example, one or more potentiometers operably coupled to an electronic circuit). Non-contact sensors (for example, one or more optical or video sensors operably coupled to an electronic circuit) can also be used.

If the hydraulic control system 510 is an electrical hydraulic control system, a separate joystick sensor, as described above for a mechanical hydraulic control system, can also be used. In an electrical hydraulic control system, movement of the joystick controls the settings of the potentiometers, which in turn controls the current or voltage to the solenoids driving the electric valves. Therefore, the current or voltage to the solenoids can also be monitored to determine whether the relative angular velocity of the dozer blade with respect to the dozer body is zero or non-zero. The hydraulic control system 510 sends the signal 507 to the communications network 502. The signal 507, based on the current or voltage to the solenoids, reports whether the relative angular velocity is zero or non-zero.

For both mechanical and electrical hydraulic control systems, the operational state of the hydraulic cylinders can also be monitored by sensors in the hydraulic control system (for example, pressure sensors or flow sensors). The hydraulic control system 510 sends the signal 509 to the communications network 502. The signal 509, based on measurements by pressure or flow sensors, reports whether the relative angular velocity is zero or non-zero.

In general, signal 505, signal 507, and signal 509 can be used separately or in combination to monitor the relative angular velocity of the dozer blade with respect to the dozer body and to report whether the relative angular velocity of the dozer blade with respect to the dozer body is zero or non-zero.

The controller unit 160 sends the output signal 510O to the communications network 502 and receives the input signal 510I from the communications network 502. The controller unit 160 receives the input signal 503I from the user input/output devices 504 and sends the output signal 503O to the user input/output devices 504. Examples of the user input/output devices 504 include a keyboard, a touchscreen, a lightbar, and a video display.

The controller unit 160 receives the measurements of the angular velocity of the dozer body ($\omega_{1x1}$, $\omega_{1y1}$, $\omega_{1z1}$) from the IMU1 140, the measurements of the angular velocity of the dozer blade ($\omega_{2x2}$, $\omega_{2y2}$, $\omega_{2z2}$) from the IMU2 150, and status signals from the joystick sensor 506 and the hydraulic control system 510. The controller unit 160 calculates an estimate of the relative attitude between the dozer blade and the dozer body, generates a feedback signal, and sends the feedback signal to the user input/output devices 104. The feedback signal can be converted to a display driver signal that drives a display such as a lightbar or video display. The display displays the difference between the estimated value and the target value of the dozer blade attitude (and, in some instances, the difference between the estimated value and the target value of the dozer blade position).

Refer to FIG. 5B. The control system shown in FIG. 5B is similar to the control system shown in FIG. 5A, except that the hydraulic control system is an electrical hydraulic control system 520 that can be automatically controlled by the controller unit 160 (in addition to being manually controlled by the joystick 120). The electrical hydraulic control system 520 sends output signal 521O to the communications network 502 and receives input signal 521I from the communications network 502. The output signal 521O can report whether the relative angular velocity of the dozer blade with respect to the dozer body is zero or non-zero. The output signal 521O can also report various control measurements. The controller unit 160 sends a feedback signal to the electrical hydraulic control system 520. The electrical hydraulic control system 520 converts the feedback signal to a control signal that controls the drive voltage or current to the solenoids that drive the electric valves to control the dozer blade attitude (and, in some instances, the dozer blade position).

Each of the interfaces shown in FIG. 5A and FIG. 5B can operate over various communications media. Examples of communications media include wires, free-space optics, and electromagnetic waves (typically in the radiofrequency range and commonly referred to as a wireless interface).

Figure 6:
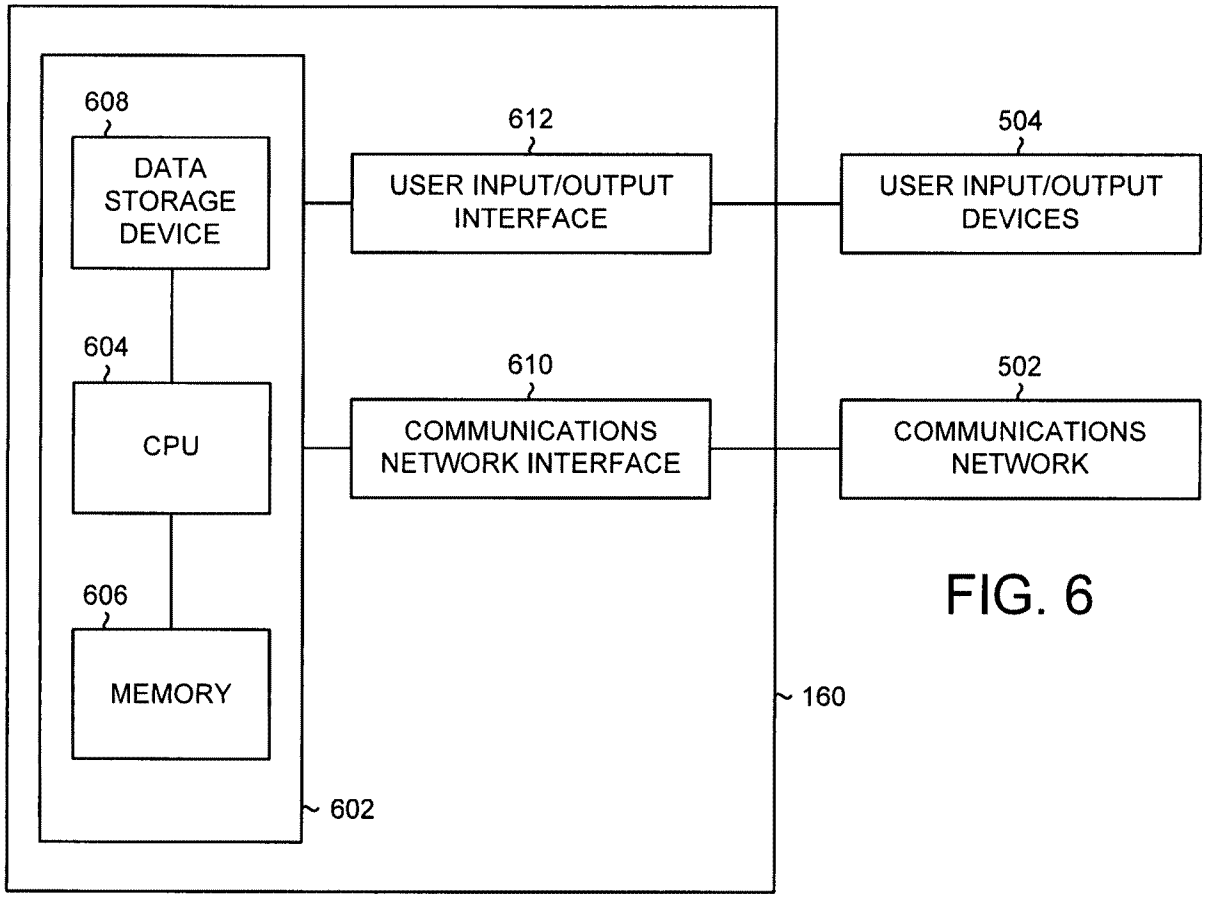
FIG. 6 shows a schematic of a controller unit.

An embodiment of the controller unit 160 is shown in FIG. 6. The controller unit 160 can be installed in the cabin 102C (FIG. 1). The controller unit 160 can be configured, programmed, and operated by a user such as a control engineer, system installation engineer, or dozer operator; different users can be restricted to only a subset of functions. For example, a dozer operator could have restricted permission only to enter reference values of blade elevation and blade orientation; a control engineer or system installation engineer, however, could also have permission to enter control algorithms and setup parameters. One skilled in the art can construct the controller unit 160 from various combinations of hardware, firmware, and software. One skilled in the art can construct the controller unit 160 from various electronic components, including one or more general purpose processors (such as microprocessors), one or more digital signal processors, one or more application-specific integrated circuits (ASICs), and one or more field-programmable gate arrays (FPGAs).

The controller unit 160 includes a computer 602, which includes a processor [referred to as a central processing unit (CPU)] 604, memory 606, and a data storage device 608. The data storage device 608 includes at least one persistent, non-transitory, tangible computer readable medium, such as non-volatile semiconductor memory, a magnetic hard drive, or a compact disc read only memory.

The controller unit 160 further includes a communications network interface 610, which interfaces the computer 602 with the communications network 502, and a user input/output interface 612, which interfaces the computer 602 with the user input/output devices 504. Note that various input/output devices (not shown) can also communicate with the controller unit 160 via the communications network 502. Data, including computer executable code, can be transferred to and from the computer 602 via a remote access terminal (not shown) communicating with the communications network 502 or via the user input/output devices 504.

As is well known, a computer operates under control of computer software, which defines the overall operation of the computer and applications. The CPU 604 controls the overall operation of the computer and applications by executing computer program instructions that define the overall operation and applications. The computer program instructions can be stored in the data storage device 608 and loaded into the memory 606 when execution of the program instructions is desired. The algorithms shown schematically in FIG. 7-FIG. 10 below can be defined by computer program instructions stored in the memory 606 or in the data storage device 608 (or in a combination of the memory 606 and the data storage device 608) and controlled by the CPU 604 executing the computer program instructions. For example, the computer program instructions can be implemented as computer executable code, programmed by one skilled in the art, to perform algorithms. Accordingly, by executing the computer program instructions, the CPU 604 executes the algorithms shown schematically in FIG. 7-FIG. 10.

FIG. 7-FIG. 10 show flowcharts summarizing methods, according to embodiments of the invention, for estimating the relative attitude of a dozer blade with respect to a dozer body. The methods can be performed, for example, by the controller unit 160. The flowcharts show the processes for one time epoch; the processes are repeated at successive time epochs. In general, the IMU1 140 (FIG. 1) outputs measurements at discrete time instants relative to a reference clock in the IMU1 140; the IMU2 150 outputs measurements at discrete time instants relative to a reference clock in the IMU2 150; and the controller unit 160 processes measurements at discrete time instants relative to a reference clock in the controller unit 160. The discrete time instants are commonly referred to as time epochs (or just epochs), and the time intervals between time epochs are referred to as epoch durations.

The epoch durations for the IMU1 140, the IMU2 150, and the controller unit 160 can be different or can be the same. The reference clocks in the IMU1 140, the IMU2 150, and the controller unit 160 can run asynchronously or can be synchronized to a common system time. If the reference clock in the IMU1 140 and the reference clock in the IMU2 150 are run asynchronously, then the sampling frequency of each IMU should be high enough such that the time difference between epochs from different IMUs are not more than a predetermined value defined by the required accuracy of the relative attitude; for example, a sampling frequency of 100 Hz should provide sufficient accuracy for most applications. In the embodiments shown in FIG. 7-FIG. 10, the steps are executed iteratively at each time epoch of the controller unit 160. Other embodiments, however, can use other timing sequences.

Figure 7:
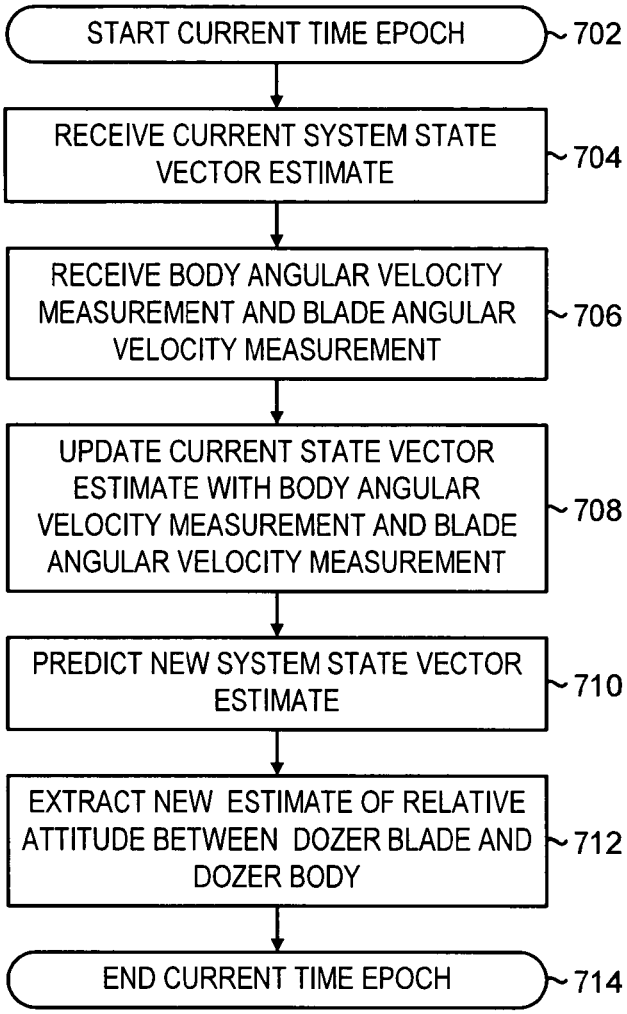
FIG. 7 shows a flowchart of a first method for estimating the attitude of a dozer blade relative to a dozer body.

Refer to embodiment shown in FIG. 7. In step 702, the current time epoch $t_k$ starts. In step 704, the current system state vector estimate $\mathcal{X}_k$ is received; for example, it was calculated during the previous time epoch and stored in memory or on a data storage device. The current system state vector estimate $\mathcal{X}_k$ includes, among its components, a representation of a current estimate of the relative attitude between the dozer blade 104 and the dozer body 102.

The process then passes to step 706, in which a body angular velocity measurement and a blade angular velocity measurement are received. The body angular velocity measurement, received from the IMU1 140 mounted on the dozer body 102, is measured with respect to the body frame: $(\omega_{1x1}, \omega_{1y1}, \omega_{1z1})$. The blade angular velocity measurement, received from the IMU2 150 mounted on the dozer blade 104, is measured with respect to the blade frame: $\omega_{2x2}$, $\omega_{2y2}$, $\omega_{2z2}$. Depending on the timing configuration, measurements from the IMU1 140 can be received before, after, or at the same time as, measurements from the IMU2 150. As discussed above, IMU1 140 and IMU2 150 each include three orthogonally-mounted gyros. In general, each IMU can include one gyro, two orthogonally-mounted gyros, or three orthogonally-mounted gyros.

The process then passes to step 708, in which the system state vector estimate is updated with the body angular velocity measurement and the blade angular velocity measurement. The updates can be performed separately or in combination. The process then passes to step 710, in which the new system state vector estimate $\mathcal{X}_{k+1}$ is predicted. The new system state vector estimate $\hat{x}_{k+1}$ includes a representation of the new estimate of the relative attitude between the dozer blade and the dozer body. The process then passes to step 712, in which the new estimate of the relative attitude between the dozer blade and the dozer body is extracted from the new system state vector estimate. In some embodiments, a new estimate of the relative position between the dozer blade and the dozer body is calculated from the new estimate of the relative attitude between the dozer blade and the dozer body and from known geometrical parameters of the dozer. The process then passes to step 714, in which the current time epoch ends.

Figure 8:
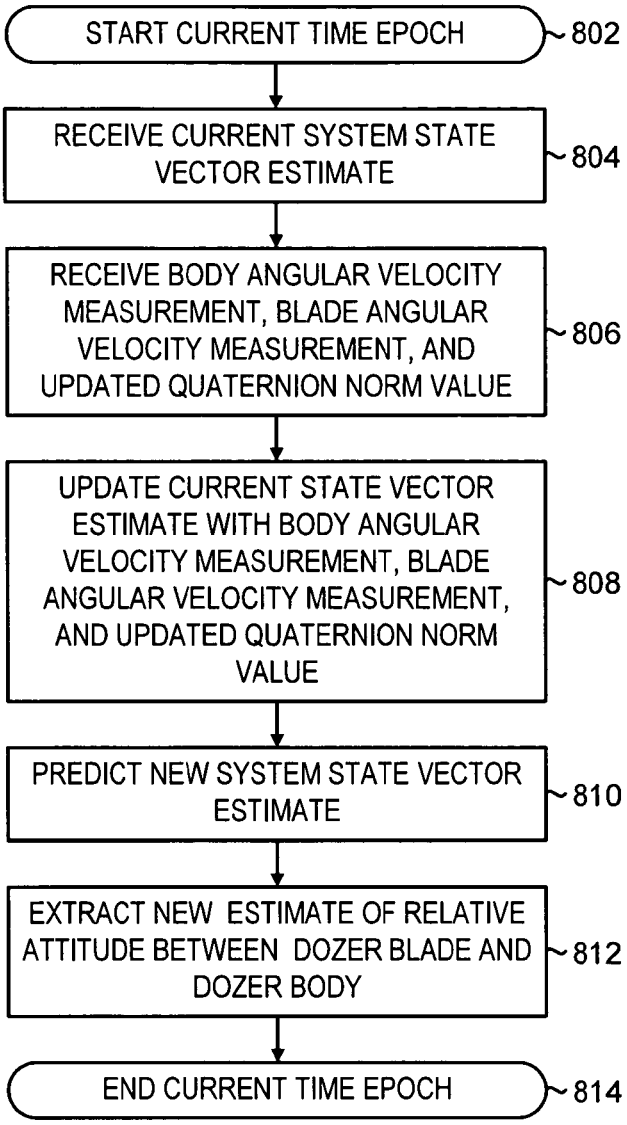
FIG. 8 shows a flowchart of a second method for estimating the attitude of a dozer blade relative to a dozer body.

Refer to embodiment shown in FIG. 8. In step 802, the current time epoch $t_k$ starts. In step 804, the current system state vector estimate $\chi_k$ is received; for example, it was calculated during the previous time epoch and stored in memory or on a data storage device. The current system state vector estimate $\chi_k$ includes, among its components, a representation by a quaternion of a current estimate of the relative attitude between the dozer blade 104 and the dozer body 102.

The process then passes to step 806, in which a body angular velocity measurement, a blade angular velocity measurement, and an updated quaternion norm value are received. Details of the body angular velocity measurement and the blade angular velocity measurement are discussed above in reference to FIG. 7. The updated quaternion norm value is 1.

The process then passes to step 808, in which the system state vector estimate is updated with the body angular velocity measurement, the blade angular velocity measurement, and the updated quaternion norm value. The updates can be performed separately or in various combinations. The process then passes to step 810, in which the new system state vector estimate $\chi_{k+1}$ is predicted. The new system state vector estimate $\chi_{k+1}$ includes a representation by a quaternion of the new estimate of the relative attitude between the dozer blade and the dozer body. The process then passes to step 812, in which the new estimate of the relative attitude between the dozer blade and the dozer body is extracted from the new system state vector estimate. In some embodiments, a new estimate of the relative position between the dozer blade and the dozer body is calculated from the new estimate of the relative attitude between the dozer blade and the dozer body and from known geometrical parameters of the dozer. The process then passes to step 814, in which the current time epoch ends.

Figure 9:
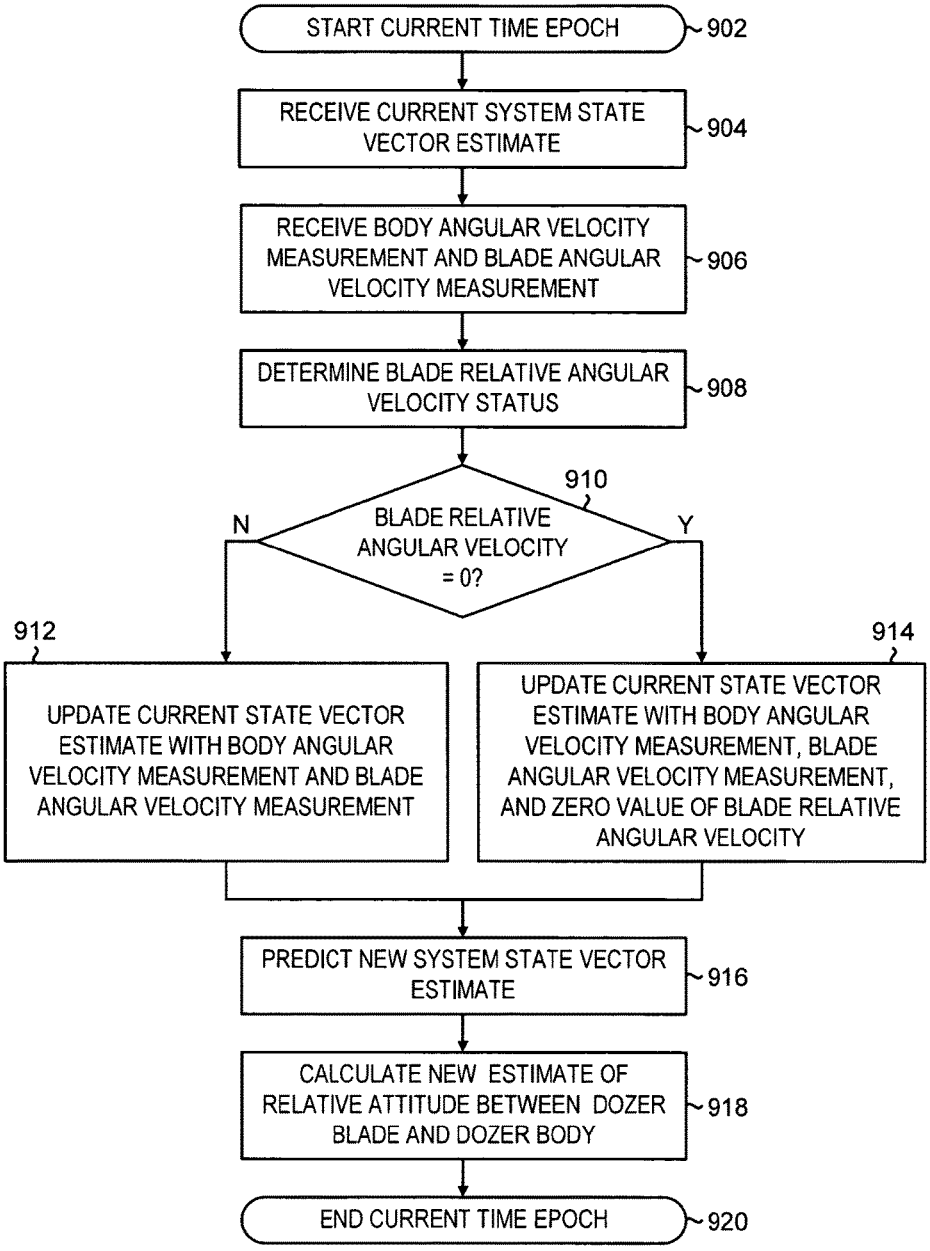
FIG. 9 shows a flowchart of a third method for estimating the attitude of a dozer blade relative to a dozer body.

Refer to embodiment shown in FIG. 9. In step 902, the current time epoch $t_k$ starts. In step 904, the current system state vector estimate $\chi_k$ is received; for example, it was calculated during the previous time epoch and stored in memory or on a data storage device. The current system state vector estimate $\chi_k$ includes, among its components, a representation of a current estimate of the relative attitude between the dozer blade 104 and the dozer body 102.

The process then passes to step 906, in which a body angular velocity measurement and a blade angular velocity measurement are received. Details of the body angular velocity measurement and the blade angular velocity measurement are discussed above in reference to FIG. 7.

The process then passes to step 908, in which the status of the blade relative angular velocity (relative angular velocity of the dozer blade with respect to the dozer body) is determined. The status of the blade relative angular velocity can be monitored and reported, for example, by signal 505, signal 507, or signal 509 (FIG. 5A). The process then passes to the decision step 910. If the blade relative angular velocity is not zero, then the process passes to step 912, in which the system state vector estimate is updated with the body angular velocity measurement and the blade angular velocity measurement. The updates can be performed separately or in combination.

Refer back to step 910. If the blade relative angular velocity is zero, then the process passes to step 914, in which the system state vector estimate is updated with the body angular velocity measurement, the blade angular velocity measurement, and the zero value of the blade relative angular velocity vector ($\omega_{r\,x2,k}=0$, $\omega_{r\,y2,k}=0$, $\omega_{r\,z2,k}=0$, where $\omega_{r(\bullet),k}$ are components of the blade relative angular velocity $\omega_{r,k}$ in the blade frame). The updates can be performed separately or in various combinations.

The process then passes to step 916, in which the new system state vector estimate $\chi_{k+1}$ is predicted. The new system state vector estimate $\chi_{k+1}$ includes a representation of the new estimate of the relative attitude between the dozer blade and the dozer body. The process then passes to step 918, in which the new estimate of the relative attitude between the dozer blade and the dozer body is extracted from the new system state vector estimate. In some embodiments, a new estimate of the relative position between the dozer blade and the dozer body is calculated from the new estimate of the relative attitude between the dozer blade and the dozer body and from known geometrical parameters of the dozer. The process then passes to step 920, in which the current time epoch ends.

Figure 10:
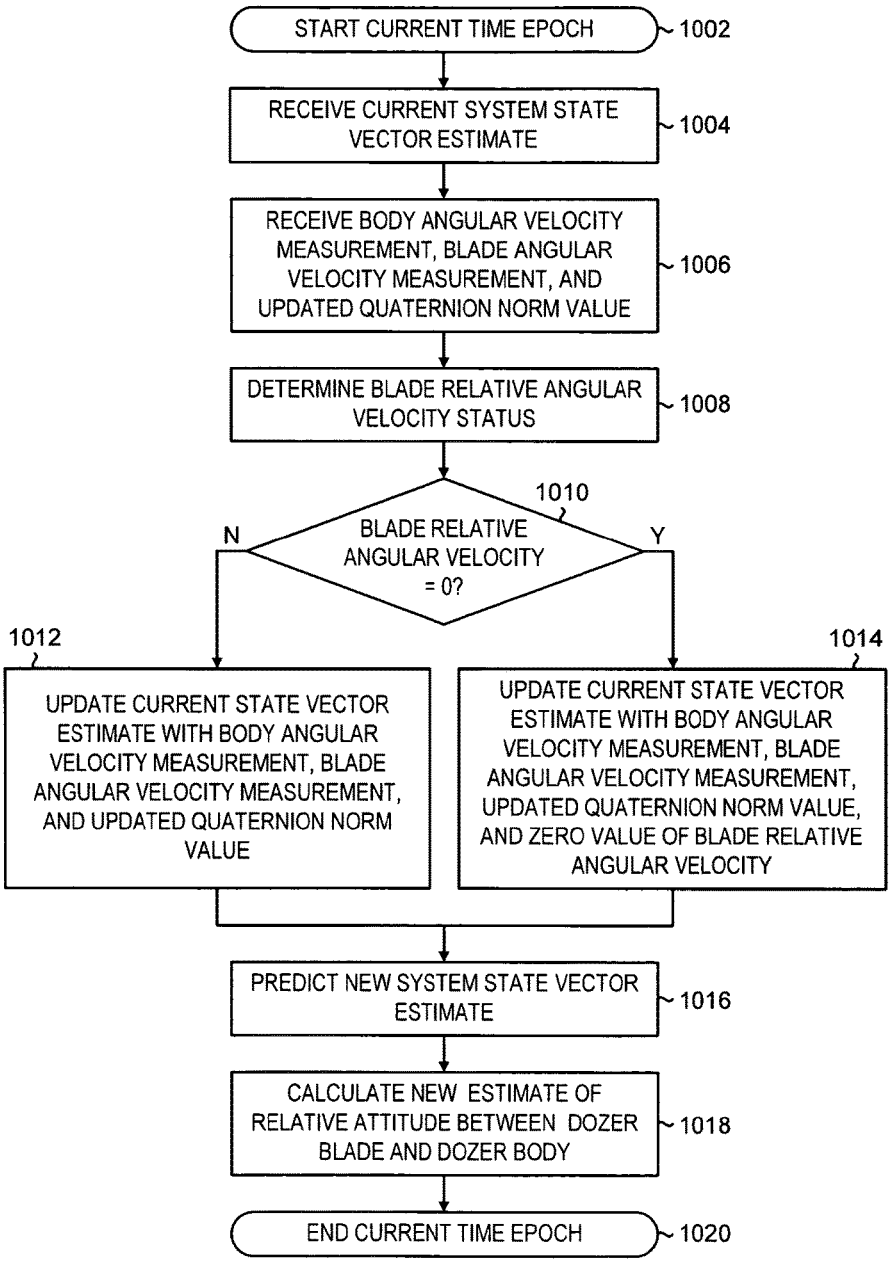
FIG. 10 shows a flowchart of a fourth method for estimating the attitude of a dozer blade relative to a dozer body.

Refer to embodiment shown in FIG. 10. In step 1002, the current time epoch $t_k$ starts. In step 1004, the current system state vector estimate $\chi_k$ is received; for example, it was calculated during the previous time epoch and stored in memory or on a data storage device. The current system state vector estimate $\chi_k$ includes, among its components, a representation by a quaternion of a current estimate of the relative attitude between the dozer blade 104 and the dozer body 102.

The process then passes to step 1006, in which a body angular velocity measurement, a blade angular velocity measurement, and an updated quaternion norm value are received. Details of the body angular velocity measurement and the blade angular velocity measurement are discussed above in reference to FIG. 7. The updated quaternion norm value is 1.

The process then passes to step 1008, in which the status of the blade relative angular velocity (relative angular velocity of the dozer blade with respect to the dozer body) is determined. The status of the blade relative angular velocity can be monitored and reported, for example, by signal 505, signal 507, or signal 509 (FIG. 5A). The process then passes to the decision step 1010. If the blade relative angular velocity is not zero, then the process passes to step 1012, in which the system state vector estimate is updated with the body angular velocity measurement, the blade angular velocity measurement, and the updated quaternion norm value. The updates can be performed separately or in various combinations.

Refer back to step 1010. If the blade relative angular velocity is zero, then the process passes to step 1014, in which the system state vector estimate is updated with the body angular velocity measurement, the blade angular velocity measurement, the updated quaternion norm value, and the zero value of the blade relative angular velocity vector ($\omega_{r\,x2,k}=0$, $\omega_{r\,y2,k}=0$, $\omega_{r\,z2,k}=0$, where $\omega_{r(\bullet),k}$ are components of the blade relative angular velocity $\omega_{r,k}$ in the blade frame). The updates can be performed separately or in various combinations.

The process then passes to step 1016, in which the new system state vector estimate $\chi_{k+1}$ is predicted. The new system state vector estimate $x_{k+1}$ includes a representation by a quaternion of the new estimate of the relative attitude between the dozer blade and the dozer body. The process then passes to step 1018, in which the new estimate of the relative attitude between the dozer blade and the dozer body is extracted from the new system state vector estimate. In some embodiments, a new estimate of the relative position between the dozer blade and the dozer body is calculated from the new estimate of the relative attitude between the dozer blade and the dozer body and from known geometrical parameters of the dozer. The process then passes to step 1020, in which the current time epoch ends.

Specific embodiments of the invention were described above for a dozer including a dozer body and a dozer blade operably coupled to the dozer body. As discussed above, embodiments of the invention are generally applicable for a vehicle including a vehicle body and an implement operably coupled to the vehicle body.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A method for estimating a relative attitude between an implement and a vehicle body, wherein the implement is operably coupled to the vehicle body, the vehicle body having a controller attached thereto and the controller is performing the method comprising the steps of:

receiving a first system state vector estimate, wherein the first system state vector estimate:

corresponds to a first time instant in a plurality of time instants; and comprises a representation of a first relative attitude estimate corresponding to the first time instant;

receiving a body angular velocity measurement from at least one body gyro mounted on the vehicle body;

receiving an implement angular velocity measurement from at least one implement gyro mounted on the implement;

computing an updated system state vector based at least in part on the first system state vector estimate, the body angular velocity vector measurement, and the implement angular velocity vector measurement;

predicting a second system state vector estimate, wherein the second system state vector estimate:

is based at least in part on the updated system state vector and a time-dependent system model;

corresponds to a second time instant in the plurality of time instants; and comprises a representation of a second relative attitude estimate corresponding to the second time instant;

measuring one or more control signals for use in determining whether a relative angular velocity of the implement with respect to the vehicle body is zero or non-zero; and controlling the implement relative to the vehicle body using the relative angular velocity, and the relative attitude estimate based at least in part on the first relative attitude estimate or the second relative attitude estimate.

2. The method of claim 1, wherein the step of computing an updated system state vector based at least in part on the first system state vector estimate, the body angular velocity vector measurement, and the implement angular velocity vector measurement is performed by an extended Kalman filter procedure.

3. The method of claim 1, wherein the representation of the first relative attitude estimate corresponding to the first time instant is a quaternion, further comprising the step of updating a value of a quaternion norm to 1, wherein:

the step of computing an updated system state vector based at least in part on the first system state vector estimate, the body angular velocity vector measurement, and the implement angular velocity vector measurement is further based at least in part on the updated value of the quaternion norm.

4. The method of claim 1, further comprising the step of determining that the relative angular velocity of the implement with respect to the vehicle body has the zero value, wherein:

the step of computing an updated system state vector based at least in part on the first system state vector estimate, the body angular velocity vector measurement, and the implement angular velocity vector measurement is further based at least in part on the relative angular velocity with the zero value.

5. The method of claim 4, wherein:

the vehicle body is a dozer body;

the implement is a dozer blade;

the dozer blade is operably coupled to the dozer body by at least one hydraulic cylinder;

the at least one hydraulic cylinder is controlled by a hydraulic control system;

the hydraulic control system is controlled by a joystick or a controller unit; and the step of determining that a relative angular velocity of the implement with respect to the vehicle body has a zero value is selected from the group consisting of:

monitoring a translation of the joystick;

monitoring a pressure of a hydraulic fluid in the at least one hydraulic cylinder;

monitoring a flow rate of a hydraulic fluid in the at least one hydraulic cylinder; and monitoring an electronic control signal in the controller unit or in the hydraulic control system.

6. The method of claim 1, wherein:

the at least one body gyro mounted on the vehicle body is selected from the group consisting of:

one body gyro mounted on the vehicle body;

two orthogonally-mounted body gyros mounted on the vehicle body; and three orthogonally-mounted body gyros mounted on the vehicle body; and the at least one implement gyro mounted on the implement is selected from the group consisting of:

one implement gyro mounted on the implement;

two orthogonally-mounted implement gyros mounted on the implement; and three orthogonally-mounted implement gyros mounted on the implement.

7. The method of claim 1, wherein the vehicle body is a dozer body and the implement is a dozer blade.

8. A controller unit for estimating a relative attitude between an implement and a vehicle body, wherein the implement is operably coupled to the vehicle body, the controller unit comprising:

a processor;

memory operably coupled to the processor; and a data storage device operably coupled to the processor, wherein the data storage device stores computer program instructions for execution by the processor which is configured to:

receive a first system state vector estimate, wherein the first system state vector estimate:

corresponds to a first time instant in a plurality of time instants; and comprises a representation of a first relative attitude estimate corresponding to the first time instant;

receive a body angular velocity measurement from at least one body gyro mounted on the vehicle body;

receive an implement angular velocity measurement from at least one implement gyro mounted on the implement;

compute an updated system state vector based at least in part on the first system state vector estimate, the body angular velocity vector measurement, and the implement angular velocity vector measurement; and predict a second system state vector estimate, wherein the second system state vector estimate:

is based at least in part on the updated system state vector and a time-dependent system model;

corresponds to a second time instant in the plurality of time instants; and comprises a representation of a second relative attitude estimate corresponding to the second time instant;

measure one or more control signals for use in determining whether a relative angular velocity of the implement with respect to the vehicle body is zero or non-zero; and control the implement relative to the vehicle using the relative angular velocity, and the relative attitude estimate based at least in part on the first relative attitude estimate or the second relative attitude estimate.

9. The controller unit of claim 8, wherein the processor computes an updated system state vector based at least in part on the first system state vector estimate, the body angular velocity vector measurement, and the implement angular velocity vector measurement using an extended Kalman filter procedure.

10. The controller unit of claim 8, wherein:

the representation of the first relative attitude estimate corresponding to the first time instant is a quaternion;

the processor is further configured to update a value of a quaternion norm to 1; and the processor computes an updated system state vector based at least in part on the first system state vector estimate, the body angular velocity vector measurement, and the implement angular velocity vector measurement further based at least in part on the updated value of the quaternion norm.

11. The controller unit of claim 8, wherein:

the processor is further configured to determine that the relative angular velocity of the implement with respect to the vehicle body has the zero value; and the processor computes an updated system state vector based at least in part on the first system state vector estimate, the body angular velocity vector measurement, and the implement angular velocity vector measurement further based at least in part on the relative angular velocity with the zero value.

12. The controller unit of claim 11, wherein:

the vehicle body is a dozer body;

the implement is a dozer blade;

the dozer blade is operably coupled to the dozer body by at least one hydraulic cylinder;

the at least one hydraulic cylinder is controlled by a hydraulic control system;

the hydraulic control system is controlled by a joystick or the controller unit; and the determination that a relative angular velocity of the implement with respect to the vehicle body has a zero value is selected from the group consisting of:

monitoring a translation of the joystick;

monitoring a pressure of a hydraulic fluid in the at least one hydraulic cylinder;

monitoring a flow rate of a hydraulic fluid in the at least one hydraulic cylinder; and monitoring an electronic control signal in the controller unit or in the hydraulic control system.

13. The controller unit of claim 8, wherein:

the at least one body gyro mounted on the vehicle body is selected from the group consisting of:

one body gyro mounted on the vehicle body;

two orthogonally-mounted body gyros mounted on the vehicle body; and three orthogonally-mounted body gyros mounted on the vehicle body; and the at least one implement gyro mounted on the implement is selected from the group consisting of:

one implement gyro mounted on the implement;

two orthogonally-mounted implement gyros mounted on the implement; and three orthogonally-mounted implement gyros mounted on the implement.

14. The controller unit of claim 8, wherein the vehicle body is a dozer body and the implement is a dozer blade.

15. A non-transitory computer readable medium storing computer program instructions for estimating a relative attitude between an implement and a vehicle body, wherein the implement is operably coupled to the vehicle body, wherein the computer program instructions, when executed by a processor, cause the processor to perform a method comprising the steps of:

receiving a first system state vector estimate, wherein the first system state vector estimate:

corresponds to a first time instant in a plurality of time instants; and comprises a representation of a first relative attitude estimate corresponding to the first time instant;

receiving a body angular velocity measurement from at least one body gyro mounted on the vehicle body;

receiving an implement angular velocity measurement from at least one implement gyro mounted on the implement;

computing an updated system state vector based at least in part on the first system state vector estimate, the body angular velocity vector measurement, and the implement angular velocity vector measurement; and predicting a second system state vector estimate, wherein the second system state vector estimate:

is based at least in part on the updated system state vector and a time-dependent system model;

corresponds to a second time instant in the plurality of time instants; and comprises a representation of a second relative attitude estimate corresponding to the second time instant;

measuring one or more control signals for use in determining whether a relative angular velocity of the implement with respect to the vehicle body is zero or non-zero; and controlling the implement relative to the vehicle using the relative angular velocity, and the relative attitude estimate based at least in part on the first relative attitude estimate or the second relative attitude estimate.

16. The non-transitory computer readable medium of claim 15, wherein the step of computing an updated system state vector based at least in part on the first system state vector estimate, the body angular velocity vector measurement, and the implement angular velocity vector measurement is performed by an extended Kalman filter procedure.

17. The non-transitory computer readable medium of claim 15, wherein:

the representation of the first relative attitude estimate corresponding to the first time instant is a quaternion;

the method further comprises the step of updating a value of a quaternion norm to 1; and the step of computing an updated system state vector based at least in part on the first system state vector estimate, the body angular velocity vector measurement, and the implement angular velocity vector measurement is further based at least in part on the updated value of the quaternion norm.

18. The non-transitory computer readable medium of claim 15, wherein:

the method further comprises the step of determining that a relative angular velocity of the implement with respect to the vehicle body has a zero value; and the step of computing an updated system state vector based at least in part on the first system state vector estimate, the body angular velocity vector measurement, and the implement angular velocity vector measurement is further based at least in part on the relative angular velocity with the zero value.

19. The non-transitory computer readable medium of claim 18, wherein:

the vehicle body is a dozer body;

the implement is a dozer blade;

the dozer blade is operably coupled to the dozer body by at least one hydraulic cylinder;

the at least one hydraulic cylinder is controlled by a hydraulic control system;

the hydraulic control system is controlled by a joystick or a controller unit; and the step of determining that a relative angular velocity of the implement with respect to the vehicle body has a zero value is selected from the group consisting of:

monitoring a translation of the joystick;

monitoring a pressure of a hydraulic fluid in the at least one hydraulic cylinder;

monitoring a flow rate of a hydraulic fluid in the at least one hydraulic cylinder; and monitoring an electronic control signal in the controller unit or in the hydraulic control system.

20. The non-transitory computer readable medium of claim 15, wherein:

the at least one body gyro mounted on the vehicle body is selected from the group consisting of:

one body gyro mounted on the vehicle body;

two orthogonally-mounted body gyros mounted on the vehicle body; and three orthogonally-mounted body gyros mounted on the vehicle body; and the at least one implement gyro mounted on the implement is selected from the group consisting of:

one implement gyro mounted on the implement;

two orthogonally-mounted implement gyros mounted on the implement; and three orthogonally-mounted implement gyros mounted on the implement.

21. The non-transitory computer readable medium of claim 15, wherein the vehicle body is a dozer body and the implement is a dozer blade.

* * * * *